US005092833A

United States Patent [19]

King et al.

[11] Patent Number: 5,092,833

[45] Date of Patent: Mar. 3, 1992

[54] SHEET DEFLECTING DEVICE FOR A PAPER FOLDING MACHINE

[75] Inventors: Werner King, Lauterbach; Joachim Kurtz, Mönchweiler; Werner Lehmann, Gutach, all of Fed. Rep. of Germany

[73] Assignee: Mathias Bauerle GmbH, Georgen/Schw., Fed. Rep. of Germany

[21] Appl. No.: 626,949

[22] Filed: Jan. 16, 1991

Related U.S. Application Data

[62] Division of Ser. No. 405,470, Sep. 8, 1989.

[30] Foreign Application Priority Data

Sep. 9, 1988 [DE] Fed. Rep. of Germany ..... 3830656

[51] Int. Cl.[5] ..... B31B 45/16; B31B 45/18

[52] U.S. Cl. ..... 493/424; 493/431; 493/435; 493/444

[58] Field of Search ..... 493/23, 424, 426, 427, 493/428, 429, 430, 431, 432, 433, 434, 435, 444

[56] References Cited

U.S. PATENT DOCUMENTS 1,837,005 12/1931 Wood ..... 493/431
1,900,288 3/1933 Jordhoy ..... 493/431
3,986,711 10/1976 Anikanov ..... 493/431
4,569,672 2/1986 Marion et al. ..... 493/359

*Primary Examiner*—William E. Terrell
*Attorney, Agent, or Firm*—McGlew & Tuttle

[57] ABSTRACT

The paper folding machine is provided with a roller pair (T1,T2) which forms an intake zone (E) and determines the velocity of feed of the material to be folded, and with at least one pair of folding rollers (W1,W2,W3), which forms a folding zone (F1) and is parallel to the former pair of rollers. A stopless feed limiting device, which determines the actual folding length and can be actuated individually for each folding operation by a microprocessor and/or an electronic control circuit as a function of a feed measuring unit, is arranged in a material feed path (4) which extends past the folding zone (F1,F2). In order to reach narrow folding length tolerances even at high working speeds, on the side of the maerial feed path (4) opposite the folding zone (F1,F2), the feed limiting device is provided with a knife-like or bar-like deflecting member (6), which extends over the width of the material feed path and can be moved toward the folding zone (F1,F2) at a velocity corresponding to the velocity of feed of the material to be folded, while the material to be folded is deflected to form a fold.

6 Claims, 4 Drawing Sheets

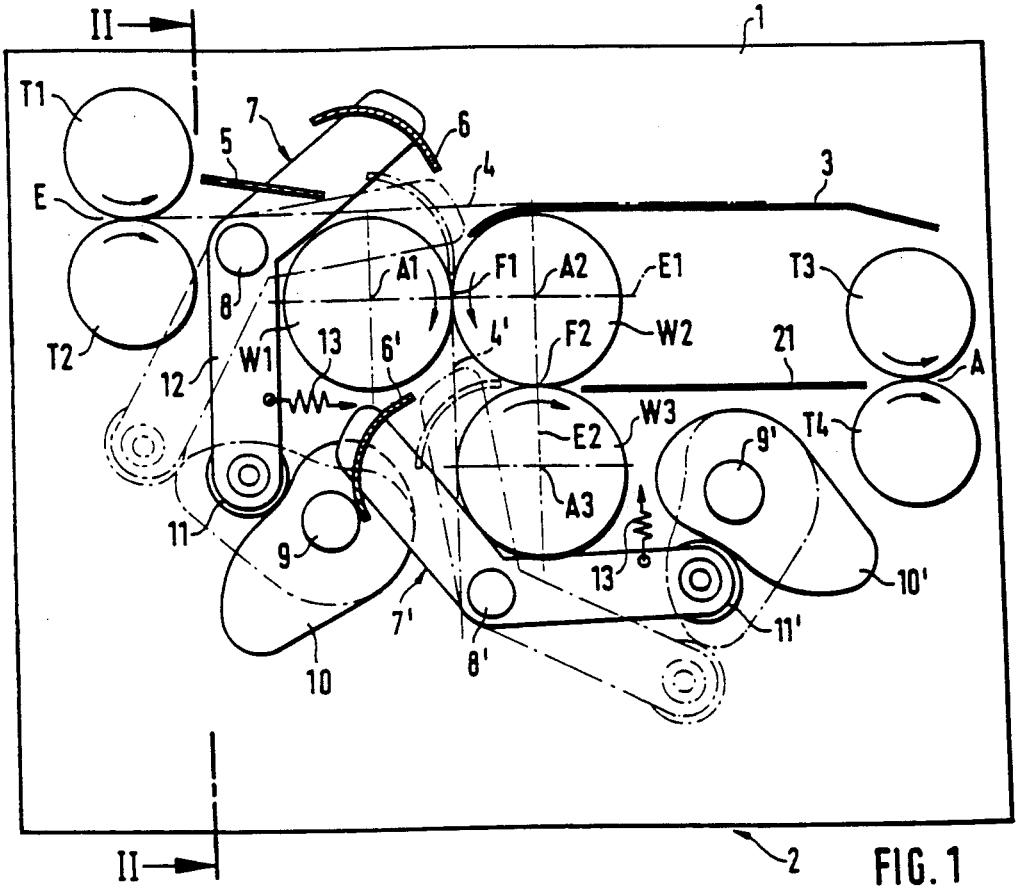
FIG. 1
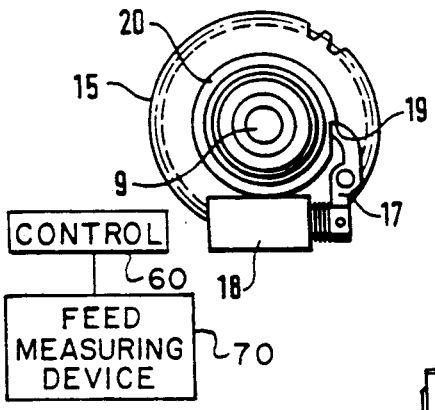
FIG. 3
FIG. 2
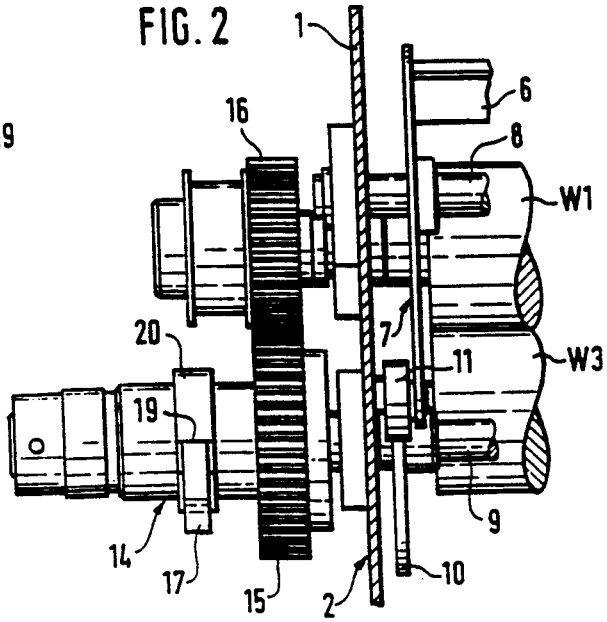

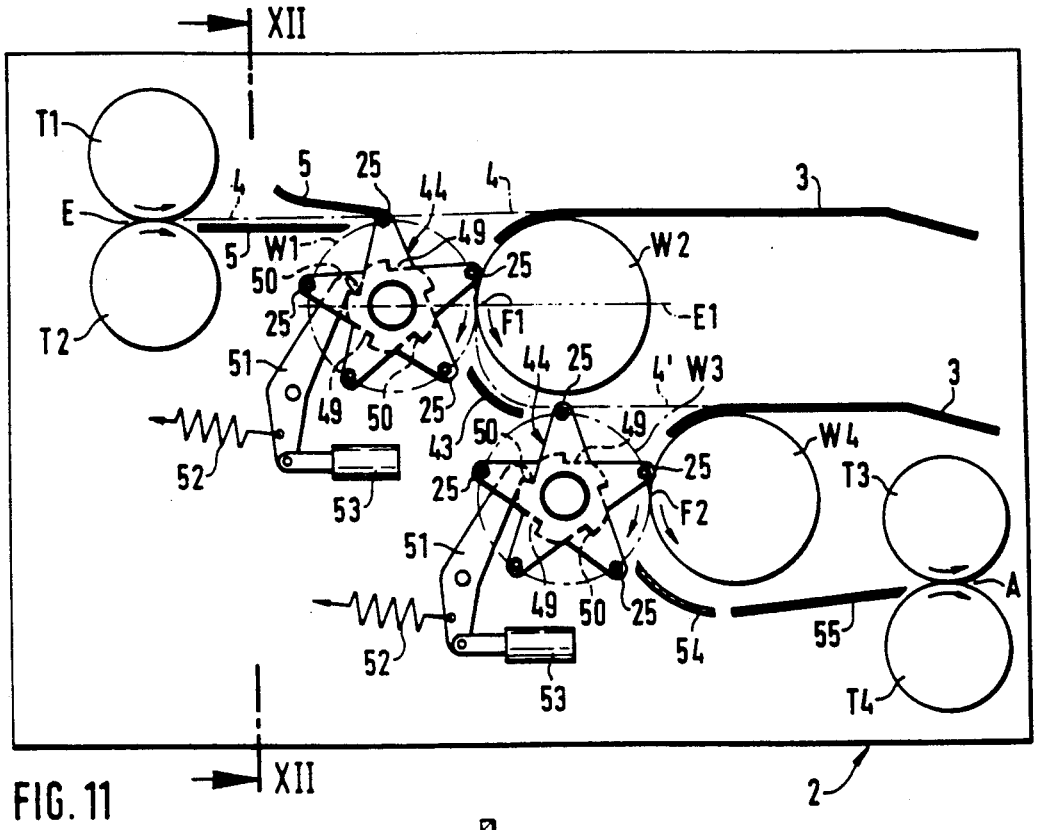
FIG. 11
FIG. 12
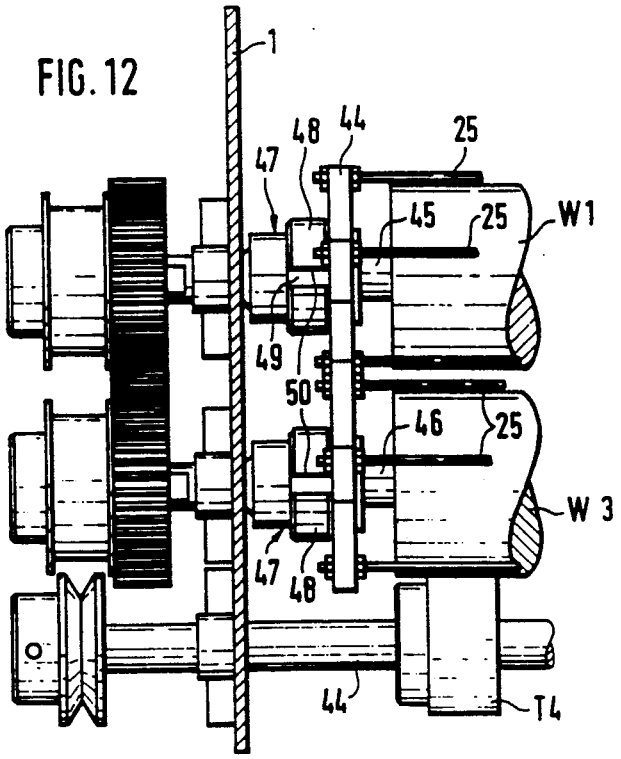

SHEET DEFLECTING DEVICE FOR A PAPER FOLDING MACHINE

This is a divisional application of application Ser. No. 07/405,470 filed Sept. 8, 1989.

FIELD OF THE INVENTION

The present invention pertains to a paper folding machine comprising a roller pair forming an intake zone, which roller pair determines the velocity of feed of the material to be folded, and at least one pair of folding rollers which are parallel to the roller pair and form a folding zone, wherein a stopless feed limiting device, which determines the folding length and can be actuated individually for each folding process by means of a microprocessor and/or an electronic control device as a function of a feed measuring device, is arranged in the material feed path moving past the folding zone.

BACKGROUND OF THE INVENTION

In a prior-art buckle folding machine (W. German patent Specification No. 27,57,182), a material guide is arranged each in front of and behind a pair of folding rollers, if viewed in the direction of transportation of the material to be folded. To interrupt the feed of the material to be folded in a preselectable manner, corresponding to the desired folding length, and to bend over the material to be folded to form a fold, feed limiters in the form of clamping members of pressure rollers are provided. These feed limiters act on the material to be folded by friction and stop the section of material being fed and/or drive it in the opposite direction. The pressure rollers press the section of material being fed against the folding roller located in the vicinity of the inlet of the material guide. The feed limiters are actuated by sensors which are arranged in the feed paths in front of each pair of folding rollers and sense the leading edge of the material being fed. The feed limiters are actuated by electromagnets, which are controlled in agreement with the desired folding length by electronic pulse generators synchronized with the folding rollers. Stationary material sensors, which sense the sections of material being fed, are mounted in the zone of the buckling space. The pulses of the pulse generator are sent as counting pulses to a presettable coincidence circuit as a function of the state or state of the material sensors, wherein the coincidence circuit ensures actuation of the feed limiters and also cancellation of the counting pulses in the coincidence circuit in the case of coincidence of the pulse count with preset number.

In this as well as other, prior-art buckle folding machines (W. German patent specification No. 673,176 and W. German Patent Specification No. 519,140), the feed limiters which are provided in the feed paths instead of the adjustable paper stops, which are otherwise commonly used in buckle folding machines, are braking or stopping means whose function is based on clamping or friction, and which block the sections of material being fed and prevent them from being fed further by pressing the material to be folded by frictional engagement either against a non-rotating surface or against the rotating shell surface of a folding roller on being actuated electromagnetically, in order to bring about folding and the feeding of the material to be folded to the nearest folding zone.

Since the mode of operation of these prior-art feed limiters is based on the generation of frictional engagement between the material to be folded and a braking member or a drive member rotating in the opposite direction, the result of the operation is unsatisfactory in terms of the folding length tolerances, especially at high working speeds.

SUMMARY AND OBJECTS OF THE INVENTION

The primary object of the present invention is to provide a paper folding machine of this type with a feed limiting device which guarantees narrower folding length tolerances even at high working speeds.

This task is accomplished according to the present invention in that the feed limiting device has a knife-like or bar-like deflecting member arranged on the side of the feed path opposite the folding zone and extending over its width, and that the deflecting member can be moved toward the folding zone at a velocity corresponding to the feed of the material to be folded , while the material to be folded is at the same time deflected to form a fold.

What is of primary importance is that the deflecting member is moved toward the folding zone at such a velocity that after reaching the surface of the material to be folded, it remains in the same place on the material to be folded during the further movement toward the folding zone, and it accurately introduces the line on the material to be folded, along which it had first reached the material, into the folding zone, so that the fold will be formed along the line. This also ensures that there will be no more relative movement between the material to be folded and the deflecting member during this deflecting movement, which guarantees equally great accuracy of the folding length at any working speed.

There are several possibilities for driving the deflecting member as well as for its path of movement. Whether the deflecting movements of the different deflecting members take place exactly synchronously with the rotary movement of the folding rollers, i.e. either at the same angular velocity or at the same circumferential velocity, is relevant only inasmuch as it must be ensured that the deflecting member remains in the same place on the material to be folded during the deflection of the material to be folded and the material to be folded does not move relative to the deflecting member during this deflecting movement in either the feed direction or the reverse direction.

Another advantage of the manner of deflecting the material to be folded toward the given folding zone according to the present invention is a considerable reduction of the working noise.

Due to the guided deflection of the material to be folded by means of a deflecting member, the cracking noises, which are caused by the suddenly changing pushing and pulling of the paper and are common or inevitable in buckle folding machines, are greatly diminished or reduced to a minimum.

High working speeds can easily be reached especially with the deflecting member attached to swivel arms and where the swivel arms are attached to a common shaft mounted eccentrically onto a folding roller.

If a cam, connected to the roller drive via a one stop electromagnetically engaged clutch, is used as a drive for the deflecting member, it is possible to exactly coordinate the movement during the deflection process to the paper feed even if the pivoting movement of the deflecting member in its initial range is opposite the direction of paper feed. This means that it is also possible to mount, e.g., the deflecting member assigned to the second folding zone behind the second folding zone in the direction of feed, which in turn makes it possible to construct the two folding zones with only three folding rollers, which are arranged in the corners of a right triangle, preferably an isosceles triangle.

The embodiments, of the present invention providing arms or holders mounted on a side of the folding roller, offer the advantage that the deflecting members perform their material-deflecting movements exactly synchronously to the rotary movements of the folding rollers,. on the axes of which they are mounted coaxially. Even though this leads to a very high accuracy of work in terms of the folding length tolerances, additional resetting drives for the deflecting members are required in one case, and a fourth folding roller is required to form the second folding zone in the second case.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

BRIEF DESCRIPTION OF DRAWINGS

In the drawings:

FIG. 1 is a schematic representation of a side view of the paper folding machine;

FIG. 2 is a sectional view taken at line II—II of FIG. 1;

FIG. 3 is a front view of elements from FIG. 2:

FIG. 11 is a simplified schematic side view of another paper folding machine; and FIG. 12 is a sectional view taken at line XII—XII of FIG. 11.

DESCRIPTION OF THE PREFERRED EMBODIMENT

Figure 4:
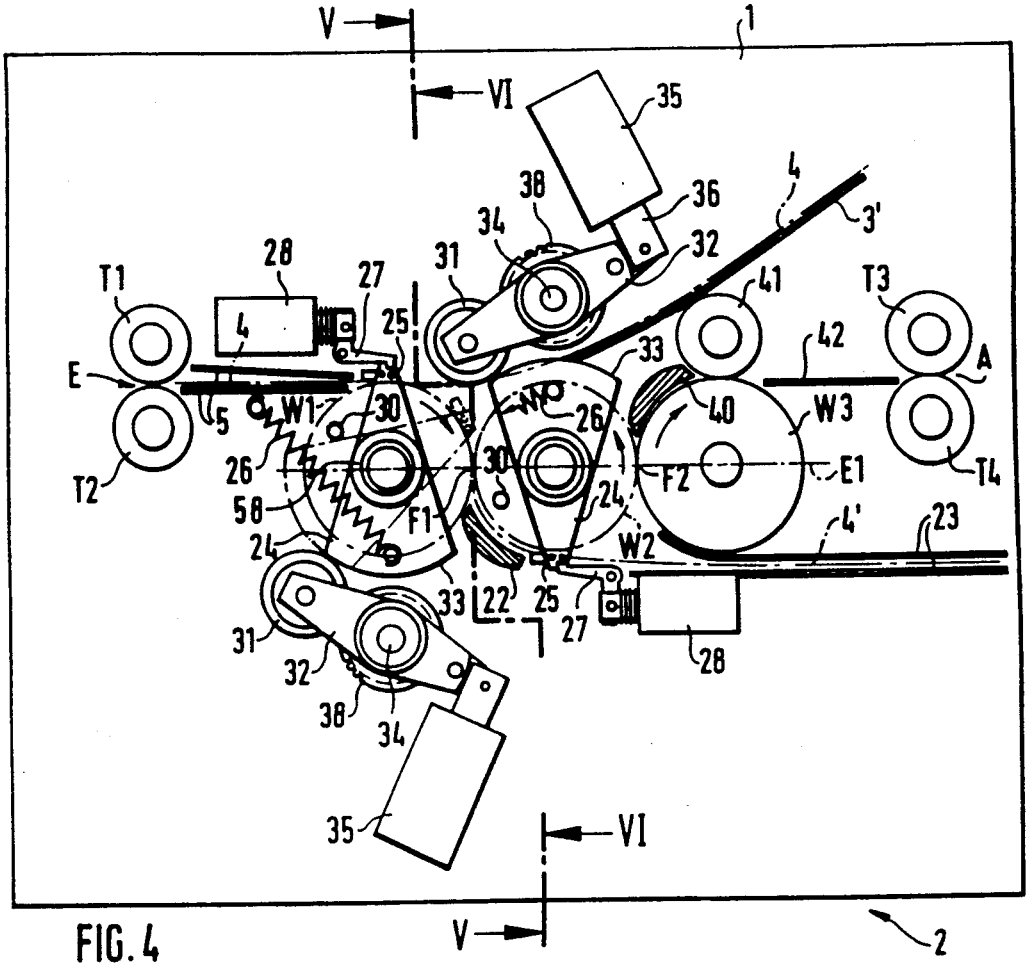
FIG. 4 is a schematic representation of the side view of another paper folding machine.

In the paper folding machine shown in FIGS. 1 through folding rollers W1,W2,W3 are arranged in a frame 2 consisting of two bedplates 1 positioned relative to one another such that their axes A1,A1, and A3 are located in the corners of an isosceles right triangle and in a horizontal plane E1 and in a vertical plane E2, and that in pairs, they form a first folding zone F1 and a second folding zone F2, contacting the shells of the folding rollers W1, W2, and W3. Two transport rollers T1 and T2 form an intake zone E for feeding in the material to be folded. Viewed in the direction of movement, two more transport rollers T3 and T4 together form a discharge zone A, through which the folded material leaves the folding machine. The intake zone E is arranged such that the material being taken in, moving approximately tangentially over the first folding roller W1 and past the first folding zone F1 reaches a paper guide 3, which in this case is located in the same horizontal plane as the intake zone E, so that it forms the feed path 4 extending past the first folding zone F2,. which is indicated by a dash-dotted line. Additional paper guides 5, which guide the material to be folded in the feed path, are arranged immediately behind the intake zone E.

On the side of the feed path 4 opposite the folding zone F1 there is arranged a knife-like or blade deflecting member 6 extending over the entire length of the folding zone 1 or the folding rollers W1 and W2, which is attached to two-armed swivel arms 7. These swivel arms 7 in turn are rotary-mounted on a common shaft 8 such that they are located axially outside the two front sides of the folding roller W1 and thus they can be pivoted past the folding roller W1. The shaft 8 is rotary-mounted eccentrically to the axis A1 of the folding roller W1 under the feed path 4 between the folding roller W1 and the intake zone E in the frame 2. A cam 10, which is attached to a shaft 9 mounted under the folding roller W1, and which can be engaged with the folding roller W1 from time to time via a one-stop clutch 14, e.g. via a wrap sling clutch, and via toothed gears 15 and 16, is provided to pivot the swivel arms 7. The shell surface of the said cam 10 is in contact with a feeler roll 11 of a second lever arm 12 of the swivel arm 7, the force of a tension spring 13 being applied to the said arm in the corresponding direction.

The one-stop clutch 14 is engaged with a detent 17, which is actuated by an electromagnet 18 and lockingly engages a locking shoulder 9 of a control ring 20 of the one-stop clutch 14 in its neutral position. When the electromagnet 18 is briefly energized, the detent 17 releases the control ring 20 for a revolution of the shaft 9 with the cam 10. The timely energization of the electromagnet 18 is controlled by an electronic control device 60, which is based on a known principle, or by means of a microprocessor, as a function of a known feed measuring device 70, which is not shown in detail.

A deflecting member 6', which is arranged on the side of the second feed path 4' opposite the folding zone F2, is provided for the second folding zone F2 as well. In the vertical direction, the said feed path 4', extending tangentially to the folding roller W3, joins the folding zone F1. This deflecting member 6' has a knife-like or blade design, like the deflecting member 6, and is attached to two swivel arms 7' of the common shaft 8' which are also actuated by a cam 10' via a one-stop clutch 14 and a feeler roll 11' against the action of a tension spring 13.

A paper guide is arranged between the folding zone F2 and the discharge zone A.

The mode of operation of this paper folding machine is essentially as follows:

The material to be folded, which is entering the feed path 4 through the intake zone E, is sensed by means of sensors (not shown), which measure the feed length, e.g., with a counter, and sent the measurement result continuously to an electronic coincidence circuit, in which a predetermined value is stored, depending on the type of fold and the length of the folding format. In the case of coincidence, the electromagnet 18 of the first one-stop clutch 14 driving the cam 10 is briefly energized, so that the cam 10 rotates through 360 degrees and brings about a pivoting movement of the swivel arms 7 and at the same time a deflecting member 6 toward the folding zone F1. This deflecting member 6 also causes deflection of the material to be folded that is moving in the feed path 4 toward the folding zone F1 to the extent that it can be caught by the two folding rollers W1 and W2 to form a fold in the folding zone F1 and can be transported into the feed path 4'. The second cam 10', which actuates the second deflecting member 6' is also controlled by an electronic control unit as a function of the feed measuring device located in the feed path 4' via a second one-stop clutch 14 such that the deflecting member 6' catches the material to be folded, which is located in the second feed path 4', in a place that is correct for the desired folding length, and deflects it toward the folding zone F2, where the second fold is formed. The folded product is subsequently ejected through the two transport rollers T3 and T4 over the paper guide 21. Due to the synchronous movement of the two cams 10 and 10' with the drive of the folding rollers W1, W2 and W3, and due to the shape of the cams 10 and 10', the velocity of deflections of the deflecting members 6 and 6' is controlled such that the edges of the deflecting members 6 and 6' which are actually resting on the material to be folded do not change their positions on the material to be folded during the deflecting movement, i.e., the deflecting movements of the deflecting members 6 and 6 are coordinated with the velocity of feed of the material to be folded. This control of the deflecting movements of the deflecting members 6,6' ensures that there is no further feed once they have caught the material to be folded.

Figure 5:
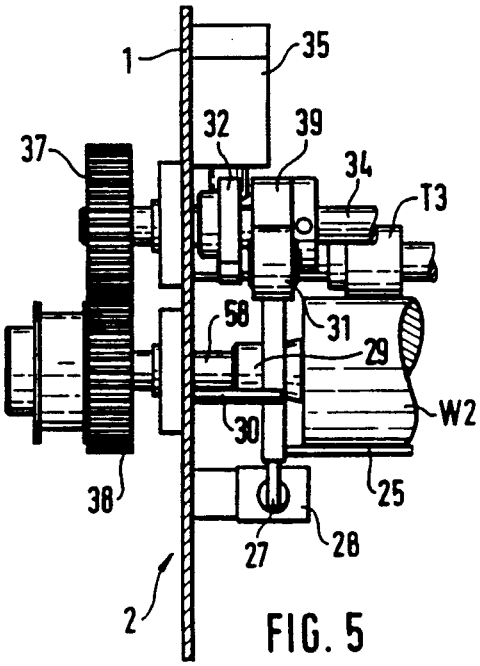
FIG. 5 is a sectional view taken at line V—V of FIG. 4.

In the embodiment according to FIGS. 4 and 5, the two folding zones F1 and F2 are formed by three folding rollers W1, W2 and W3 which together are mounted in the horizontal plane E1. As is indicated by the arrows showing the sense of rotation of these folding rollers W1 through W3, the material being folded passes through the first folding zone F1 from the top to bottom and it passes through the second folding zone from bottom to top. The two transport rollers T1 and T2, which form the intake zone E, are present in this case as well, with the material to be folded arriving through the said intake zone passing in the horizontal direction tangentially to the roller W1 over the folding zone F1 and to a paper guide 3' directed obliquely upward. Consequently, the first feed path 4 has essentially the same pattern here as in the embodiment according to FIG. 1. Behind the first folding zone F1 in the direction of movement, there is a diverting plate 22, which delivers the material to be folded, arriving in the vertical direction, around the middle folding roller W2 into a horizontal feed path 4', which is defined by a pocket-like, but stopless paper guide 23 and is indicated, like the feed path 4, by a dash-dotted line.

To deflect the material to be folded from the feed path 4, a thin, bar-like, wire-like or blade deflecting member 25, whose axis is parallel to that of the folding roller W1, is attached to two swivel arms 24, which are pivoted on the two sides of the folding roller W1 coaxially to the latter roller at a short radial distance from the folding roller W1, the deflecting member is also located on the side of the feed path 4 opposite the first folding zone F1 due to its radially spaced location from the folding roller W1. Due to the two paper guides 5 and 3', the feed path 4 is placed such that it passes through between the shell surface of the folding roller W1 and the deflecting member 25 in the starting or neutral portion of the swivel arms 24 as shown in FIG. 4.

The swivel arms 24 are under action of tension springs 26, which apply a torque in the direction of rotation of the folding roller W1 to the swivel arms and consequently also to the deflecting member 25. However, the swivel arms 24 are also electrically releasably locked in their starting position shown in FIG. 4, which is brought about by a detent 27 that can be actuated by an electromagnet 28 in the sense of release. To ensure that after their release, the swivel arms 24 will not move at a higher velocity than the folding roller W1 but synchronously with the folding roller W1, overrunning clutches 29 are arranged between the swivel arms 24 and the shaft 58 of the folding roller W1. These overrunning clutches 29 enable the locking levers 24 to perform a free pivoting movement opposite the sense of rotation of the folding roller W1, but they prevent the swivel arms 24 from moving faster in the direction of rotation of the folding roller W1 than the folding roller itself. Synchronization of the folding roller W1 with the deflecting member 25 or the swivel arms 24 in the direction of deflection, i.e. toward the folding zone F1, is thus guaranteed.

This pivoting movement of the swivel arms 24 is limited by a stop 30, which may be adjustable if desired. This stop 30 is set or arranged such that the deflecting member 25 can be moved—during simultaneous loop-like deflection of the sheet to be folded that is located under it—in the sense of rotation of the folding roller W1 only so far that it itself will not reach the folding zone F1, but it deflects the material to be folded to such a close location to the folding zone F1 that the material to be folded will be caught by the two folding rollers W1 and W2 forming the folding zone F1 and pulled through the folding zone F1. As soon as the swivel arms 24 have reached this deflection position, represented by dash-dotted lines in FIG. 4, a resetting drive starts to function, which pivots the two swivel arms 24 back into their starting position, in which they will again be locked by the detent 27 until the next deflecting movement is released by the electromagnet 28. This resetting drive consists of a friction roller 31, which is rotary-mounted on a two-armed lever 21 and can be pressed against a segmental arch 33 of a swivel arm 24. The arch is concentric to the axis Al of the folding roller W1. The lever 32 is rotary-mounted on a shaft 34 mounted eccentrically to the folding roller W1 in the frame 2 and can be pivoted by an electromagnet 35, whose armature 36 engages the lever arm opposite the friction roller 31. The shaft 34 carries a non-rotatable toothed gear 37, which meshes with a toothed gear 38 attached to the shaft 58 of the folding roller W1 in the opposite direction. The shaft 34 also carries a friction wheel 39, which continuously drives the friction roller 31 by friction.

When the electromagnet 35 is energized in the deflection and position of the swivel arms 24, it pulls the friction roller 31 against the segmental arch 33 of the swivel arm 24, so that the latter is turned back into its starting position. As soon as this has reached this starting position and is locked by the detent 27, the electromagnet 35 is turned off and the friction roller 31 is again lifted off the segmental arch 33 of the swivel arm 24 by a corresponding pivoting of the lever 32 induced by a return spring (not shown).

The folding roller W2 is also equipped with the same deflecting device as the folding roller W1. The only difference is that the deflecting device of the folding roller W2 is in an upside-down arrangement compared with the arrangement of folding roller W1. The resetting drive for the two swivel arms 24 with the deflecting member 25 is also exactly the same as that of the swivel arms 24 of the folding roller W1.

When the material, which is folded first in the folding zone F1, has been fed into the feed path 4' by the predetermined folding length, between the folding roller W2 and the deflecting member 25, the electromagnet 8 is energized by a corresponding pulse of an electronic measuring and control device, so that the detent 27 releases the swivel arms 24 with the deflecting member 25, and the said swivel arms bring about a deflection of the material to be folded toward the folding zone F2 synchronously with the roller W2.

A diverting plate 40, which diverts the material arriving from the folding zone F2 under pressure rollers 41 over a paper guide 42 to the discharge zone A of the transport rollers T3 and T4, is arranged behind the folding zone F2. The deflecting device of the folding roller W2 has the same parts as the deflecting device of the folding roller WI and it's functioning is also the same. The corresponding parts are therefore also identified by the same reference numerals.

Figure 6:
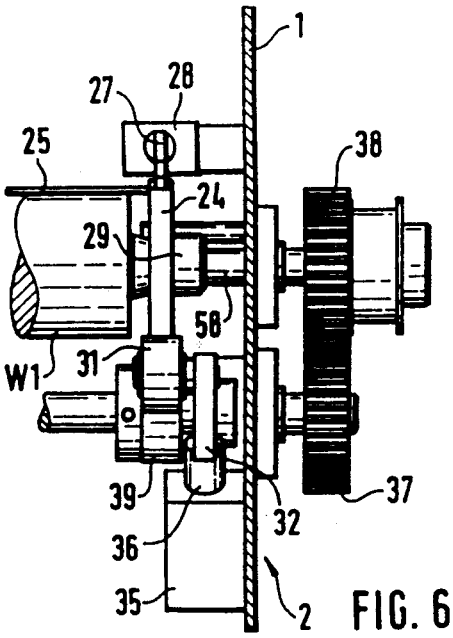
FIG. 6 is a sectional view taken at line VI—VI of FIG. 4.
Figure 7:
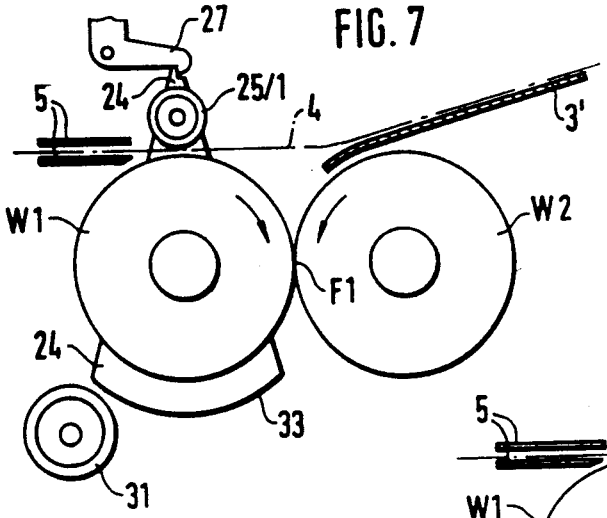
FIG. 7 is a simplified schematic representation of a variant of the paper folding machine according to FIG. 4 in the starting position of another deflecting member.
Figure 8:
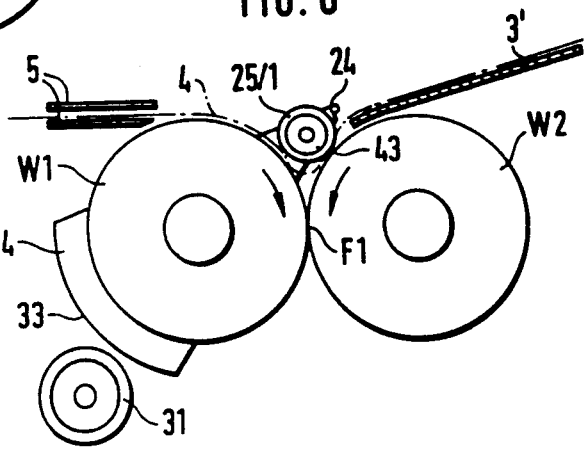
FIG. 8 is a schematic representation showing the embodiment according to FIG. 7 in the deflected position of the deflecting member.

FIGS. 7 and 8 as well as 9 and 10 show schematically two variants of the paper folding machine shown in FIGS. 4–6, in which variants the deflecting member 25/1 provided on the swivel arms, which are present here just as in the embodiment according to FIGS. 4–6, is a rotary-mounted roller 25/1 or a cylindrical round bar, rather than a bar-like or wire-like member.

Figure 9:
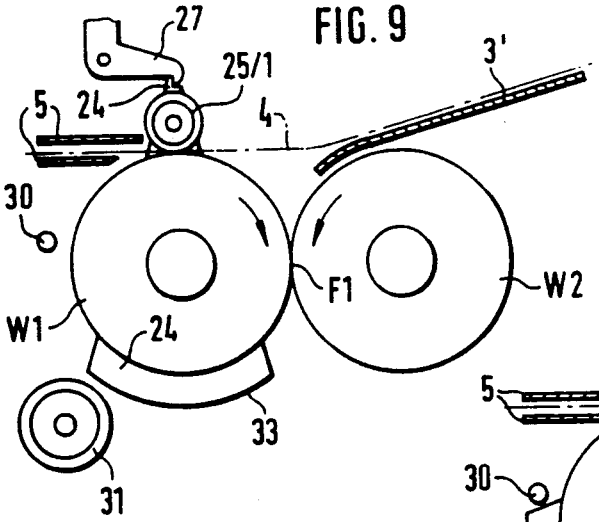
FIG. 9 is a schematic representation of another variant of the paper folding machine according to FIG. 4 in the starting position of the deflecting member.
Figure 10:
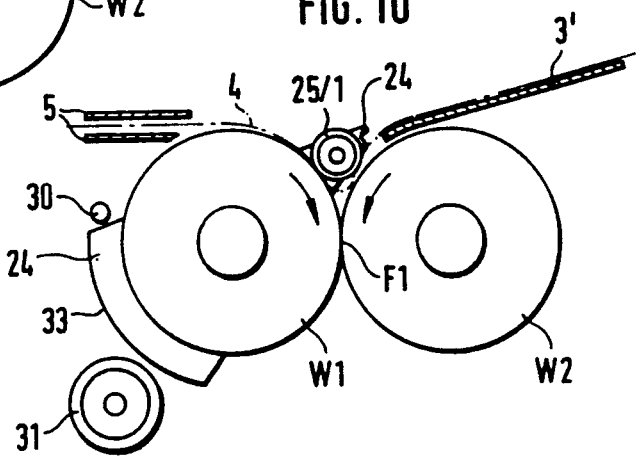
FIG. 10 is a schematic representation of the embodiment according to FIG. 9 in the deflected position of the deflecting member.

In the variant according to FIGS. 7 and 8,. the deflecting member 25/1, which is designed as a freely rotatable roller or round bar, is arranged such that it is located at a radially spaced location from the shell surface of the folding roller W1, and the incoming material to be folded is able to pass through freely between those two parts in the feed path 4. However, in this case the swivel arms 24 with the deflecting member 25/1 are deflected only so far that the deflecting member 25/1 presses the material to be folded against the shell surface of the folding roller W2, as is shown in FIG. 8, so that a frictional drive toward the folding zone F1 is generated between the material to be folded and the folding roller W2 in the area of contact 43. This can be advantageous especially in the case of thick or stiffer paper grades. However,. the same advantage can also be achieved with the variant shown in FIGS. 9 and 10, in which the deflecting member 25/1, which consists of a rotatable roller in this case as well, is mounted in the swivel arms 24 such that it is in frictional connection with the shell surface of the folding roller W1 and the material to be folded, which arrives in the feed path 4, is brought into frictional connection with the folding roller W1 when the swivel arms 24 are still in their starting position. This frictional connection is preserved even when the deflecting movement is performed toward the folding zone F1, so that an additional feed of the material being folded now also takes place toward the folding zone F1 when the deflecting movement of the swivel arms 24 or the defecting member 25/1 has stopped.

The return movement of the deflecting member 25/1 into its starting position is not hindered as a consequence of its ability to rotate freely.

The deflecting member of the folding roller W2 may also be designed and arranged analogously.

The embodiments, which are represented in a greatly simplified form in FIGS. 7 and 8 as well as 9 and 10, other wise correspond to the embodiment according to FIGS. 4–6. In a manner similar to the embodiment of FIGS. 4–6, fixed or adjustable stops 30 may also be provided for the swivel arms 24 to limit the deflecting movement for the embodiments shown in FIGS. 9 and 10.

FIG. 4 also shows that in this embodiment, only three folding roller W1, W2 and W3 are needed to form two folding zones arranged one after another, but their arrangement is different from the arrangement in the embodiment shown in FIG. 1.

FIGS. 11 and 12 show a schematic, greatly simplified representation of another embodiment of the paper folding machine according to the present invention, in which four folding rollers W1, W2 and W3 and W4 are provided to form the two folding zones F1 and F2, the folding rollers W1 and W2 forming the folding zone F1 and the folding rollers W3 and W4 forming the folding zone F2. While the folding rollers W1 and W2 are arranged in one horizontal plane E1, the folding rollers W3 and W4 are arranged in a horizontal plane E3 located under the first plane. The arrangement is such that thee is a space between the folding roller W2 and the folding roller W3, through which the second feed path 4' is passed. From the intake zone E, which is formed by the two transport rollers T1 and T2 or by corresponding transport rollers, the feed path 4, which is indicated by a dash-dotted line, is defined by the paper guides 5 and 3, while the second feed path 4' is defined by a paper guide 3' above the fourth folding roller W4 and a diverting plate 43 arranged between the folding zone F1 and the third folding roller W3. The folding rollers W1 and W3, which are arranged before the folding zone F1 and F2, respectively, in the direction of feed: Five thin, bar-shaped or wire-shaped deflecting members 25, which are attached to holding members preferably designed as star or disk shaped holders 44 are located around and with their axes being parallel to those of the folding rollers W1 and W3. The deflection members have equal angular distances of 72 degrees from one another and have equal radial distances from the shell surface of the folding roller W1 or W3. The material being folded is able to pass unhindered through the folding roller W1 and W3 and the deflecting member 25 located precisely above the feed path r and 4', respectively.

As is recognizable from FIG. 11, the holders consist of five-armed disks and are mounted on their front side coaxially to the folding rollers W1 and W3 on the shafts 45 and 46, respectively, of the folding rollers. The said holders 44 can be individually coupled with the shafts 45 and 46, respectively, by means of tripping clutches 47 to perform one tripping movement through 72 degrees. These tripping clutches may be designed, for example, as so-called wrap sling clutches, which have one control ring 48 each. The circumference 5 of the control ring 48 has five radial recesses 49, which are spaced at 72 degrees from one another and have a radial locking shoulder 50 each. A detent 51, which is under both the action of a tension spring 52, and of an electromagnet 53, engages with the locking shoulders 50 and recesses 49. While the tension spring 52 pulls the detent 51 to engage it with one of the recesses 49, the electromagnet 53, when it is briefly energized at a predetermined position of the sheet to trigger a deflecting movement of the material to be folded, causes the control ring 48 to be released by deflecting the detent 51, so that it will be disengaged from the locking shoulder 50 in the radial direction. The rotary movement, which now begins immediately, releases the control ring 48 together with the holder 44 for one predetermined internal preferably a 72 degree tripping movement. Since the detent 51 is deflected by electromagnet 53 for a short time only, it will engage in the next recess 49 of the control ring 48 and thus it will stop the control ring 48 and also the holder 44 until the electromagnet 53 receives the next deflecting pulse.

While the deflecting members in the embodiments described above in connection with FIGS. 1 through 10 must be returned into their starting position by a reverse movement, the deflecting member 25 that has stopped immediately before the folding zone F1 or F2 passes through the folding zone F1 or F2 during the next deflection. The arrangement selected is such that one deflecting member 25 will always stop in the position shown in FIG. 11 directly above the feed path 4 and 4', respectively, after each tripping or folding, and the material to be folded can pass through between this deflecting member 25, which is in the starting position, and the folding roller W1 or W3. The feed of the material to be folded in the two feed paths 4 and 4' is measured by an electronic measuring device in this case as well. Each time a predetermined feed value, which corresponds to the desired folding length, has been reached, the electromagnet 53 receives a corresponding deflecting pulse.

When the material being folded has subsequently also passed through the second folding zone F2 in the above mentioned manner to form the second fold, it is delivered over a second diverting plate 54 and another paper guide 55 to the discharge zone A of the transport rollers T3 and T4.

To ensure that the deflecting members 25 can move unhindered past the folding zones F1 and F2, the folding rollers W2 and W4 may each be provided with an elastic jacket and/or they may be mounted radially elastically relative to the corresponding folding roller W1 and W3.

While specific embodiments of the invention have been shown and described in detail to illustrate the application of the principles of the invention, it will be understood that the invention may be embodied otherwise without departing from such principles.

What is claimed is:

1. A paper sheet folding machine, comprising:

transport roller pair means forming an intake zone and determining velocity of feed of the paper sheet to be folded;

a folding roller pair, disposed adjacent to said transport roller pair, said folding roller paid forming a folding zone having a width;

stopless feed limiting means positioned adjacent a paper sheet feed path extending from said transport roller pair to beyond said folding zone, said stopless feed limiting means determining folding length of the paper sheet to be folded, said stopless feed limiting means including five thin, bar-shaped or wire-shaped sheet deflecting members extending over the width of the folding zone and having angular distances of 72 degrees from each other, one of said deflecting members being positioned in a starting position on a side of said feed path opposite said folding zone, said sheet deflecting members being spaced a short radial distance from an outer sheet surface of one of said folding roller pair, tripping clutch means, connected to said sheet deflecting members by holding members, for rotating said deflecting members in predetermined intervals from said starting position at a velocity corresponding to the feed of the paper sheet to be folded simultaneously deflecting the paper sheet toward the folding zone, said holding members being star-shaped and being mounted coaxially and rotatively on sides of one of said folding roller of said pair of folding rollers; and said tripping clutch means being electromagnetically engageable clutch means bringing said holding members into a temporary fixed rotary connection with said folding roller pair for providing said holding elements and said sheet deflecting members with tripping rotations of 72 degrees in one direction.

2. A paper sheet folding machine according to claim 1, wherein: a folding roller of said folding roller pair includes an outer elastic surface.

3. A paper sheet folding machine according to claim 1, wherein: a folding roller of said folding roller pair is mounted in a radially elastic manner.

4. A paper sheet folding machine comprising:

first and second folding rollers defining a folding zone, said first and second folding rollers being rotatable;

a plurality of deflecting members located at spaced locations around one of said first and second folding rollers defining a feed path for the sheet;

tripping clutch means for rotating said plurality of deflecting members around said one of said first and second folding rollers at a predetermined position of the sheet with respect to said deflecting members, said tripping clutch means rotating said deflecting members for a predetermined interval moving said predetermined position of the sheet into said folding zone, said tripping clutch means continuing rotation of said deflecting members through said folding zone to said position defining said feed path after a folded portion of the sheet has passed through said folding zone, and during said predetermined interval rotation, said tripping clutch means moving one of said plurality of deflecting members into said position defining said feed path, moving another of said plurality of deflecting members and said predetermined position of the sheet into said folding zone, and moving yet another one of said plurality of deflecting members through said folding zone.

5. A folding machine in accordance with claim 4, wherein:

said tripping clutch means rotates said deflecting member during said predetermined interval at a rate similar to said one of said first and second folding rollers.

6. A folding machine in accordance with claim 4, wherein:

said plurality of defecting members contains five deflecting members spaced 72 degrees apart around said one of said first and second roller, and said predetermined interval of rotation by said tripping clutch means is 72 degrees.

* * * * *